US005761378A

United States Patent [19]

Boyle et al.

[11] Patent Number: 5,761,378

[45] Date of Patent: Jun. 2, 1998

[54] HAIR CURLER STEAMER WITH PTC HEATER AND THERMALLY ISOLATED COLD AND HOT WATER RESERVOIRS

[75] Inventors: Bryan J. Boyle, Audubon, Pa.; Mario B. Accumanno, E. Hanover, N.J.; Chia-Wu Chu, Taichung, Taiwan

[73] Assignee: Helen of Troy Limited, El Paso, Tex.

[21] Appl. No.: 421,808

[22] Filed: Apr. 13, 1995

[51] Int. Cl.[6] ..... F17C 7/04

[52] U.S. Cl. ..... 392/403; 392/394; 219/505; 132/228

[58] Field of Search ..... 392/394, 399, 392/402–403, 405–406; 132/228; 219/505, 530, 540

[56] References Cited

U.S. PATENT DOCUMENTS

| | | | |
|---|---|---|---|
| 1,420,692 | 6/1922 | Cohen | 392/405 |
| 2,211,407 | 8/1940 | Christensen | 392/405 |
| 2,443,417 | 6/1948 | Duncan | 392/405 |
| 2,468,010 | 4/1949 | Duberstein . | |
| 2,847,546 | 8/1958 | Crowley . | |
| 2,847,548 | 8/1958 | Gordon . | |
| 3,610,879 | 10/1971 | Katzman . | |
| 3,705,415 | 12/1972 | Katzman . | |
| 3,714,391 | 1/1973 | Katzman . | |
| 3,739,787 | 6/1973 | Keldmann | 132/9 |
| 3,749,106 | 7/1973 | Kelmann | 132/33 |
| 3,809,374 | 5/1974 | Schossow | 392/406 |
| 3,864,440 | 2/1975 | Giocoechea | 392/403 |
| 3,873,806 | 3/1975 | Schossow . | |
| 3,934,114 | 1/1976 | Godel | 219/222 |
| 3,971,913 | 7/1976 | Myklebust . | |
| 3,990,441 | 11/1976 | Hoyt . | |
| 4,009,713 | 3/1977 | Simmons | 128/193 |
| 4,132,883 | 1/1979 | Grime . | |
| 4,177,375 | 12/1979 | Meixner | 219/441 |
| 4,225,542 | 9/1980 | Wall | 261/142 |
| 4,230,935 | 10/1980 | Meixner | 219/523 |
| 4,288,684 | 9/1981 | Katou . | |
| 4,298,787 | 11/1981 | Barradas | 219/222 |
| 4,399,349 | 8/1983 | Deming . | |
| 4,447,705 | 5/1984 | Bullock | 219/222 |
| 4,463,248 | 7/1984 | Katzman . | |
| 4,516,011 | 5/1985 | Jeffress | 219/222 |
| 4,647,755 | 3/1987 | Mack | 219/222 |
| 4,680,444 | 7/1987 | Skovdal | 219/222 |
| 4,771,797 | 9/1988 | Kosaka | 132/272 |
| 4,791,272 | 12/1988 | Thaler | 219/222 |
| 4,874,924 | 10/1989 | Yamamoto et al. | 392/403 |
| 5,010,905 | 4/1991 | Snyder | 132/272 |
| 5,207,236 | 5/1993 | Santhouse | 132/227 |
| 5,247,604 | 9/1993 | Chiu | 392/406 |
| 5,255,694 | 10/1993 | Caruso | 132/228 |
| 5,309,930 | 5/1994 | Presser | 132/272 |
| 5,355,591 | 10/1994 | Caruso . | |
| 5,361,322 | 11/1994 | Glucksman | 392/405 |

FOREIGN PATENT DOCUMENTS

| | | |
|---|---|---|
| 0 097 074 | 5/1983 | European Pat. Off. . |
| 657511 | 5/1985 | Japan . |
| 63-42882 | 11/1988 | Japan . |

*Primary Examiner*—John A. Jeffery

*Attorney, Agent, or Firm*—John E. Toupal; Harold G. Jarcho

[57] ABSTRACT

A steamer for a steamable hair curler includes thermally isolated cold and hot water reservoirs. Water in the hot water reservoir is heated by a PTC heater. The volumetric capacity of the hot water reservoir is very small. The PTC heater has an intrinsic cutoff temperature high enough to boil water in the hot water reservoir and low enough to prevent deterioration of any component parts of the steamer, even in the absence of water in the hot water reservoir. Due to the thermal isolation of the reservoirs, water in the cold water reservoir is not substantially heated during normal operation of the steamer.

21 Claims, 8 Drawing Sheets

HAIR CURLER STEAMER WITH PTC HEATER AND THERMALLY ISOLATED COLD AND HOT WATER RESERVOIRS

RELATED APPLICATION DATA

The subject matter of the present application is related to that disclosed and claimed in commonly assigned, co-pending design patent application Ser. Nos. 29/033,471 and 29/033,496 both filed on Jan. 13, 1995, and both entitled "Steamer for a Hair Curler".

FIELD OF THE INVENTION

The present invention relates generally to steam generating apparatus. In particular, the present invention relates to a steam generating apparatus ("steamer") for a steamable hair curler. However, the present application is not limited to a steamer for a steamable hair curler, except as expressly set forth in the claims hereto.

BACKGROUND OF THE INVENTION

Steam hairsetters are known in the art. Typically, a steam hairsetter comprises a plurality of steamable hair curlers and a steamer for generating steam from water in a reservoir to heat the hair curlers via the steam. The hair curlers are placed, one at a time, on a post of the steamer to allow the steam escaping from a steam outlet under the post of the steamer to moisten an absorbent portion of the curler (typically a polymeric foam). See, e.g. commonly assigned U.S. Pat. Nos. 3,759,271 and 4,453,554, incorporated herein by reference. Examples of steamers heretofore used in connection with steamable hair curlers can be found in commonly assigned U.S. Pat. Nos. 5,255,694, 5,309,930 and 5,355,291, also incorporated herein by reference. Other examples of steamers can be found in U.S. Pat. Nos. 3,610,879, 3,971,913, 3,714,391 and 4,463,248.

Prior art steamers typically employ one or more electrodes that extend into a reservoir for heating water therein when the electrodes have been energized. The electrodes are of commonly of a carbon steel composition and are adapted to generate heat when either 110 VAC or 220 VAC power has been applied. The heat boils water in the reservoir to generate the steam. The steamer may be adapted to be powered by both 110 VAC and 220 VAC sources. In these so-called "dual voltage" steamers, the electrodes are usually designed to be powered at 110 VAC, and the steamer usually comprises rectifier circuitry that effectively converts the output of a 220 VAC source to 110 VAC power. Thus, circuitry and/or switching is needed to render such steamers "dual voltage" capable. If the user neglects to switch the steamer from 110 VAC to 220 VAC before the steamer has been plugged into a 220 VAC source and used, hazardous electrical conditions may result and the steamer may be damaged. Conversely, if the user neglects to switch the steamer from 220 VAC to 110 VAC before the steamer has been plugged into a 110 VAC source and used, the steamer may not operate properly. In addition, if for some reason, the user exposes the electrodes, he or she may be severely injured.

One characteristic of these electrodes is that both their power consumption and heat output is relatively high. By way of example, one presently available steamsetter steamer available from the assignee hereof that uses these electrodes requires about 725 watts of input power (5.8 amps at 125 volts).

Many prior art steamers have a single reservoir and they heat all of the water that has been poured into the reservoir by the user. Some purport to have a separate "boiling chamber" in fluid communication with a main reservoir such that, it is said, only the water in the boiling chamber is heated to boiling and the water in the main reservoir is not substantially heated. See, e.g., U.S. Pat. Nos. 3,714,391 and 4,132,883. However, as seen in these patents, the volumetric capacity of the boiling chamber is still rather large, which means that a large amount of water will be heated to boiling temperature at any given time. These steamers also employ the same type of electrodes previously discussed, i.e., they have relatively high heat output.

In addition, it is likely that the water in the main reservoirs of the steamers described in the above mentioned '391 and '883 patents will become heated during normal operation. This is due, at least in part, to the high heat output of the electrodes employed therein, the size and/or number of the fluid flow orifices needed between the main reservoir and boiling chamber needed to replenish the boiling chamber at a sufficient rate, and the relatively large volume of hot water present in the boiling chamber at any given time (at least in relation to that present in the main reservoir).

One other characteristic of these prior art steamers is that it can take quite some time for the water in the reservoir to become heated sufficiently to reach boiling temperature because the electrodes rely upon the conductivity of the water in the reservoir to complete the electrical circuit between the electrodes. For this reason, it has generally been recommended that salt be added to the water because salt increases the conductivity of the water. Thus, the addition of salt improves the electrical function of the electrodes and reduces the amount of time that it takes for the steamer to begin generating steam.

It is desirable to provide a steamer that has dual voltage capability, yet does not require voltage changing switching and/or circuitry. It is also desirable that such steamer employs a heating element that does not have the above described drawbacks of conventional electrodes and that has relatively low power consumption. It is further desirable to provide a steamer that does not require the addition of salt to the water to provide quick boiling. Finally, it is desirable that such steamer have a heating chamber that is thermally isolated from a main reservoir such that the water in the main reservoir is not heated, and that the volumetric capacity of the heating chamber be very small. The present invention satisfies all of these goals.

SUMMARY OF THE INVENTION

A portable steam generating apparatus according to the present invention comprises separate main and hot water reservoirs. The main reservoir has an opening for receiving water from a source external to the apparatus. The hot water reservoir is thermally isolated from the first reservoir and has a relatively small volumetric capacity. The main reservoir has a volumetric capacity that is significantly greater than the volumetric capacity of the hot water reservoir.

The hot water reservoir has a relatively small steam outlet and there is a flow passage from the main reservoir to the hot water reservoir; otherwise, the hot water reservoir is substantially sealed. The flow passage provides a path for water in the main reservoir to flow to the hot water reservoir. Preferably, the reservoirs are constructed of a thermoplastic material.

A self regulating heater, comprising a positive temperature coefficient (PTC) thermistor, is disposed in the hot water reservoir. The heater has an intrinsic cutoff temperature that is great enough to boil the water in the hot water reservoir and low enough to prevent deterioration of any component parts of the apparatus, including the thermoplastic material, even in the absence of water in the reservoirs.

As a consequence of this structure, there is no substantial heating of the water in the main reservoir in normal operation of the apparatus.

DETAILED DESCRIPTION OF THE PREFERRED EMBODIMENTS

Figure 1:
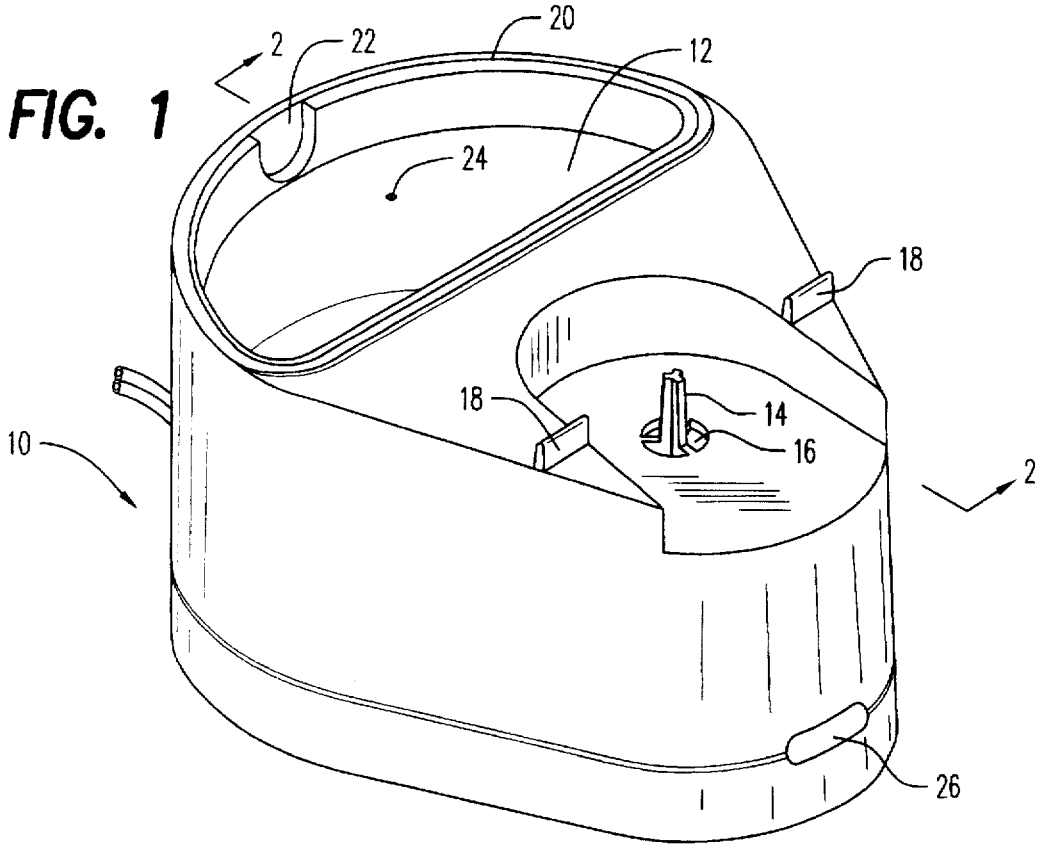
FIG. 1 is a perspective view of one embodiment of a steamer according to the present invention.
Figure 6:
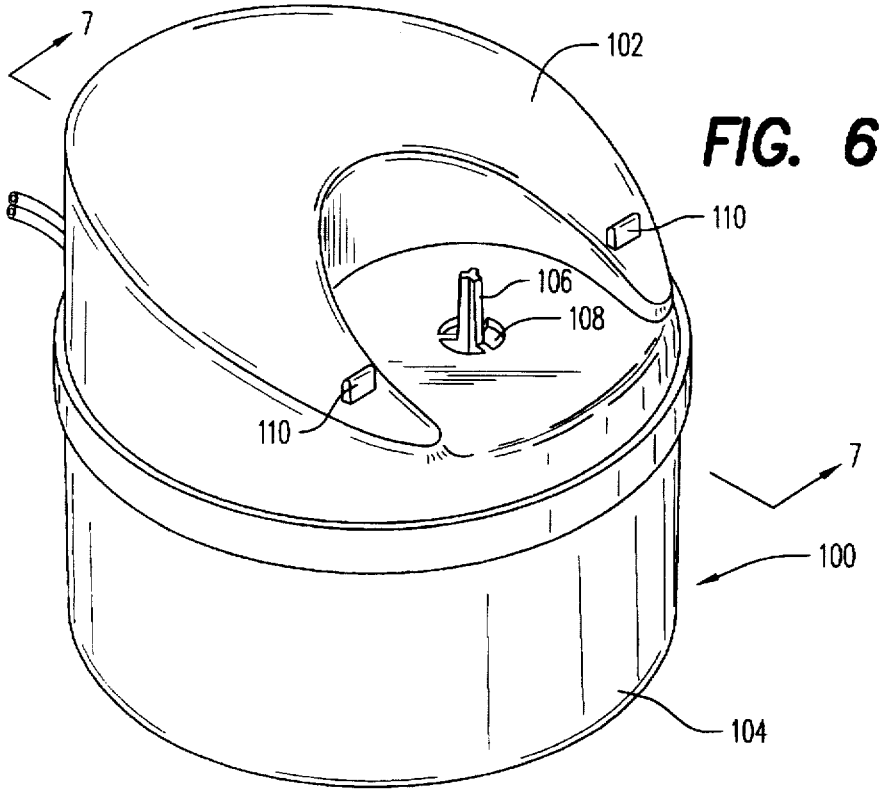
FIG. 6 is a perspective view of another embodiment of a steamer according to the present invention.

Referring now to the drawings, wherein like numerals represent like elements, there is illustrated in FIGS. 1–4 and 6–10, respectively, two embodiments of a steamer according the present invention. Though different in implementation, each is commonly characterized by thermally isolated main (cold) and hot water reservoirs coupled by a very small fluid path and use of a positive temperature coefficient (PTC) heater in the hot water reservoir, and wherein the hot water reservoir has a volumetric capacity that is very small, at least in relation to the volumetric capacity of the main reservoir. The volumetric capacity of the hot water reservoir is preferably not larger than is required to boil all of the water therein, with a PTC heater having a maximum heat output that is relatively low, when that reservoir is full.

Turning now to FIGS. 1–4, there is illustrated therein a first embodiment of a steamer 10 according to the invention. As shown in FIG. 1, the steamer 10 comprises a main reservoir 12 having a relatively large opening at the top thereof, as shown, for receiving water, e.g., from a tap. A removable cover 20 for the opening may be provided. The cover 20 shown drops into the reservoir and has a lip 21 that rests on the periphery of the opening to the reservoir 12. The cover is preferably clear, and has a small hole 24 for venting purposes. A notch 22 may be provided in the body of the steamer, as shown. The notch 22 facilitates removal of the cover 20 via a user's finger, and also serves as an overflow for the reservoir 12. Thus, the bottom-most portion of the notch 22 defines the maximum water level of the reservoir 12. The side wall 23 of the cover 20 preferably covers the notch when in place. In a preferred embodiment, not shown, two notches instead of the one shown, each laterally displaced relative to the location of the illustrated notch 22 (i.e., on opposite sides of the illustrated notch 22), are employed, and are positioned to facilitate removal of the cover 20 via two of the user's finger's, e.g., thumb and index finger.

The steamer 10 has a post 14 for positioning and holding a hair curler to be steamed over a steam outlet 16 (see, e.g., U.S. Pat. No. 5,255,694). As will be explained in more detail hereinafter, the steam outlet 16 communicates with a hot water reservoir where steam is generated. Adjacent the post 14 is a pair of tabs 18 for positioning and holding a shield or cover portion of the hair curler over the steam outlet for purposes of optionally steaming the shield.

A light 26 is illuminated when the steamer has been powered on.

Figure 2:
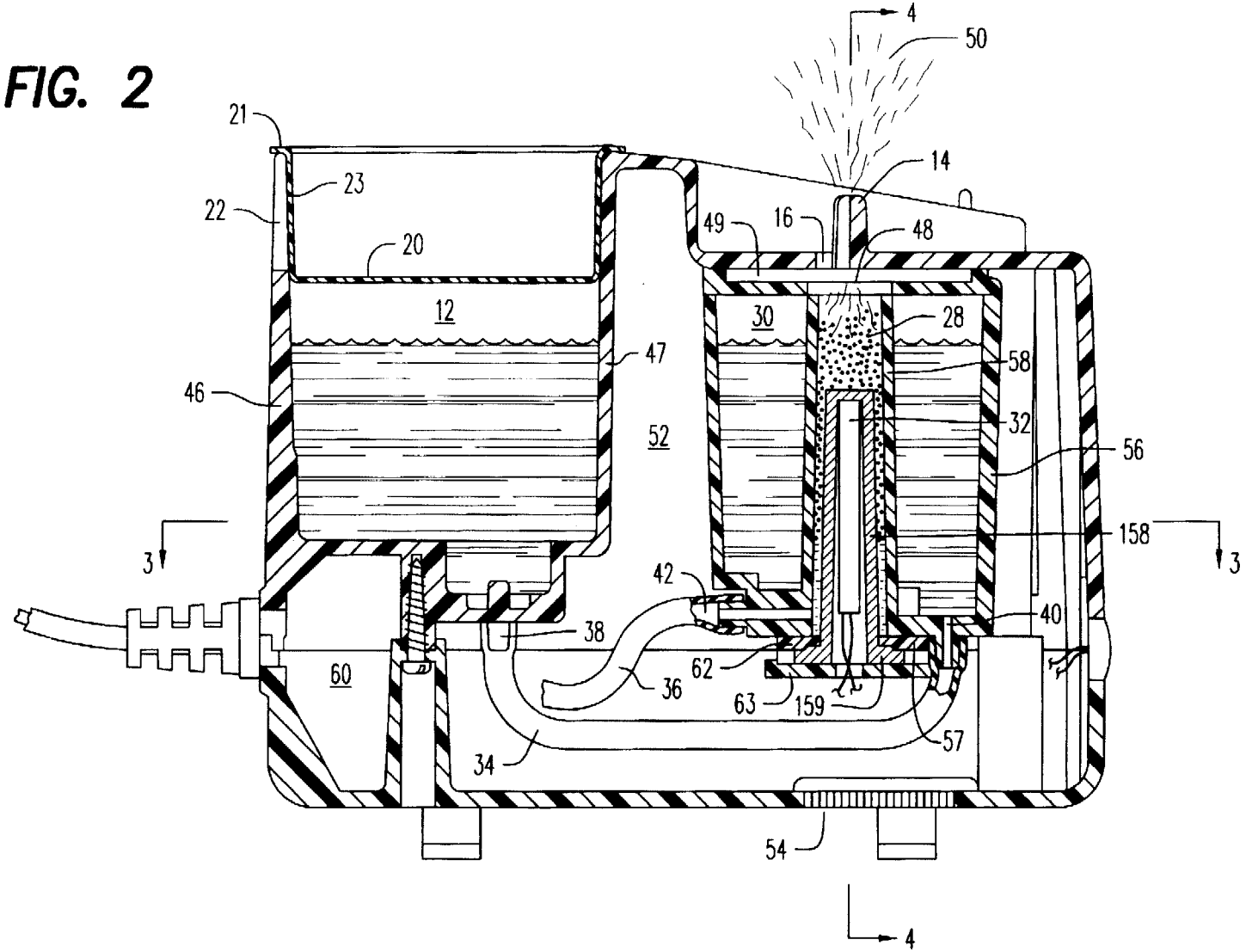
FIG. 2 is a cross section taken along line 2—2 of FIG. 1.
Figure 3:
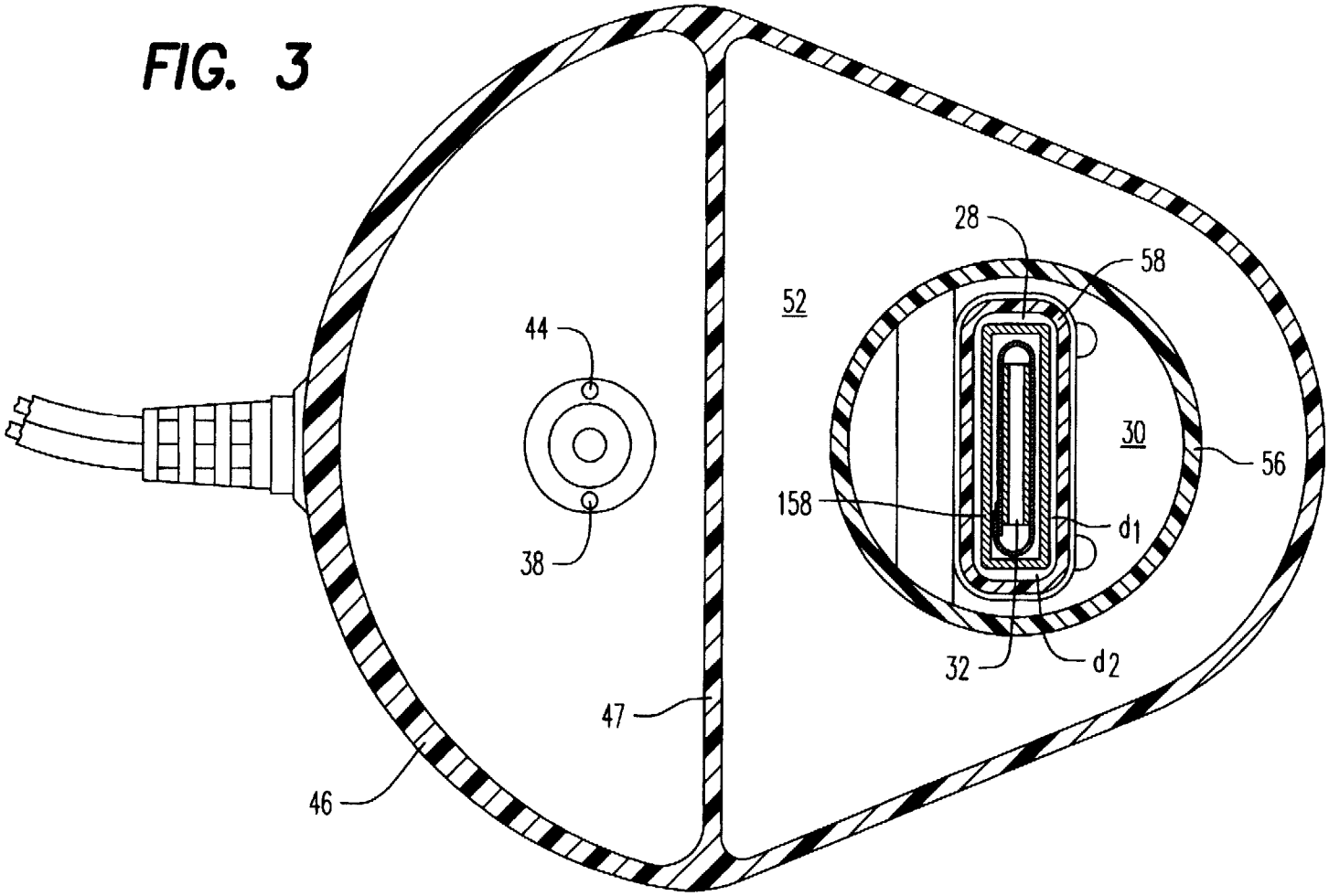
FIG. 3 is a cross section taken along line 3—3 of FIG. 2.
Figure 4:
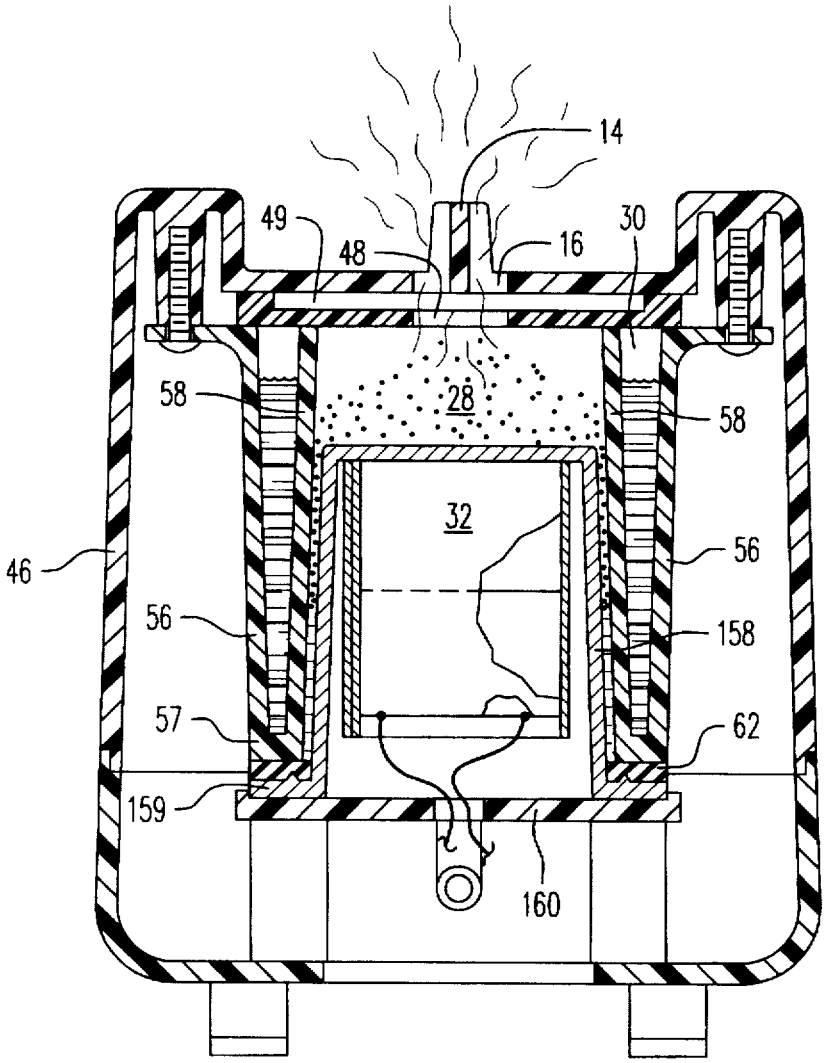
FIG. 4 is a cross section taken along line 4—4 of FIG. 4.

Referring to FIGS. 2–4, it is seen that the outer wall 46 of the steamer 10, and an internal wall 47, define the main reservoir 12. Disposed at the bottom of the main reservoir 12, and extending through the bottom wall thereof, is a pair of nipples 38, 40, each having a small hole extending therethrough. One of the nipples 38 has one end of a tube 34 coupled thereto; the other nipple 44 has one end of a tube 36 coupled thereto. Each nipple 38, 40 has a small bore therethrough to allow water to flow from the reservoir 12 into their respective tubes 34, 36.

A small cavity 60 disposed beneath the main reservoir 12 contains electrical connections to a power cord and conventional circuitry, not shown, such as a fuse, and the like.

A chamber is defined by a generally rectangular or ovally shaped wall 58. A PTC heater 32, the details of which are described hereinafter, is disposed within this chamber. A small opening or passageway 48 at the top of the chamber communicates with the steam outlet 16 via a small chamber 49. In one embodiment, the diameter of passageway 48 is about 7.5 mm, and the area of steam outlet 16 ia about 59 $mm^2$. Laterally, the space between the outside walls 158 of a housing of the PTC heater 32 and the inside of the wall 58, and, longitudinally, the space between a seal 62 and the passageway 48 defines the hot water reservoir 28. (Note that the seal 62 is disposed between the bottom wall 57 and a flange portion 159 of the PTC heater housing 158; a mounting bracket 63 and a fastening means (not shown) couple the flange 159 and seal 62 to the bottom wall 57.) In one embodiment, and with reference to FIG. 3, the distance $d_1$ between the "long" walls of the housing 158 and the adjacent walls 58 of the reservoir 28 is about 0.8 mm and the distance $d_2$ between the "short" walls of the housing 158 and the adjacent walls 58 of the reservoir 28 is about 1.0 mm.

A nipple 42 has a small bore therethrough and extends from the hot water reservoir 28 to a location exteriorly thereof. The other end of the tube 36 is coupled to the nipple 42 such that the hot water reservoir 28 is fed from the main reservoir 12 thereby. Steam generated in the hot water reservoir 28 is thus permitted to escape via the small passageway 48, via chamber 49, to steam outlet 16 to provide steam 50 for moisturizing hair curlers disposed on the post 14. Except for the small passageway 48 (whose communication with the exterior is further limited by the relatively small steam outlet 16), the hot water reservoir 28 is sealed from the atmosphere. The bore through each of the nipples 42, 44 is large enough to satisfy the steam generating requirements of the heater/hot water reservoir, but small enough to prevent any hot water in the hot water reservoir 28 from heating the water in the main reservoir 12 by any substantial amount in normal operation. In one embodiment, the diameter of the bores through the nipples 38, 40, 42, 44 is about 2.0 mm.

Another reservoir 30 is defined by a generally circular internal wall 56. A nipple 40 has a small hole therethrough and extends from the reservoir 30 to a location exteriorly thereof. The other end of the tube 34 is coupled to the nipple 40 such that the reservoir 30 is fed from the main reservoir 12 thereby. The reservoir 30 is substantially sealed. In one embodiment, the volumetric capacity of the chamber 30 is about 33 ml.

Preferably, the steamer housing and all of the interior walls thereof described herein, are constructed of a thermoplastic material, such as polypropylene, except that the walls 56, 57 and 58 (which are one integral piece) are constructed of a polycarbonate such as polyphenylene sulfide.

It will be seen that the hot water reservoir 28 is concentric with the reservoir 30, i.e., the reservoir 30 surrounds the hot water reservoir 28, such that water in the reservoir 30 comes into contact with, and surrounds, the exterior of the wall 58 of the hot water reservoir 28. The reservoir 30 thereby is in heat transfer contact with the hot water reservoir 28 and functions as a heat sink to prevent overheating of the hot water reservoir 28 or it components. It will be appreciated that the level of water in the reservoir 30 will always be substantially the same as that in the hot water reservoir 28.

As shown, the main reservoir 12 and the hot water reservoir 28 are laterally displaced relative to each other, and a considerable air space 52 separates them. The reservoirs 12 and 28 are thereby substantially thermally isolated. An air vent 54 disposed in the body of the steamer, preferably just beneath the PTC heater, communicates with this air space. As a consequence of: (i) the hot water reservoir 28 being laterally displaced from the main reservoir 12; (ii) the air space 52 separating the main and hot water reservoirs 12, 28; (iii) the heat sink reservoir 30 surrounding the hot water reservoir 28 and also being laterally displaced, via the air space 52, from the main reservoir 12; iv) the air vent 54 permitting the air space 52 to communicate with outside air; and, (v) the relatively small diameter of the bores extending through the nipples 42, 44 (which prevents any substantial backflow of hot water from the hot water reservoir 28 to the main reservoir 12), the water in the main reservoir is not heated by any substantial amount by the PTC heater 32 or the hot water in the hot water reservoir 28 in normal operation. Thus, assuming that a user has placed cold water or room temperature water in the main reservoir 12, the temperature of the water therein will not exceed room temperature in normal use.

As a result of the hot water reservoir 28 being sealed from the atmosphere, except via the small passageway 48 and steam outlet 16, the opportunity for hot water to spill out of the steamer when the unit has been tipped or dropped is minimized. Further, because there is no substantial passageway for sufficient amounts of air to quickly travel into the hot water reservoir 28 to replace the water therein when the unit is tipped, the ability of the hot water to rapidly pour out of the hot water reservoir 28 is significantly restricted. Thus, any hot water spillage occurs relatively slowly.

In addition, as will be appreciated from the drawings, and as discussed further hereinafter, the volumetric capacity of the hot water reservoir 28 is very small, particularly in relation to hot water reservoirs of prior art steamers, and also in relation to the volumetric capacity of the main reservoir 12. In one embodiment, the volumetric capacity of the main reservoir 12 is about 200 ml and the capacity of the hot water reservoir 28 is about 5.0 ml. Thus, even if complete spillage of the hot water reservoir 28 does occur, the amount of hot water available to spill is very small.

FIGS. 6–10 illustrate a second embodiment of a steamer according to the present invention. Turning to FIG. 1, it will be seen that the steamer 100 of the second embodiment comprises separable upper and lower body portions 102, 104, respectively. The lower body portion 104 is merely a container that defines the main reservoir 112; all other components of the steamer 100, including the hot water reservoir and heating element, are disposed in the upper body portion 102. As shown, the lower body portion 104 has a lip 105 that receives the upper body portion 102. Thus, when the upper body portion 102 has been removed from the lower body portion 104, the main reservoir 112 is exposed to receive water via the large opening at the top thereof from an external source, e.g., a tap or faucet.

As before, the steamer 100 has a post 106 for positioning and holding a hair curler to be steamed over a steam outlet 108. The steam outlet 108 communicates with a hot water reservoir, where steam is generated, in a manner described below. Adjacent the post 106 is a pair of tabs 110 provided for purposes previously described in connection with the steamer 10.

FIGS. 7–10 illustrate further details of the steamer 100. It will be seen that the upper body portion 102 comprises a downwardly extending cylindrical wall 118 that is integral with, and extends downwardly from, a plate 140. A bottom 142 is sealingly attached to the wall 118 so as to define a water tight, air filled chamber 116. The volumetric capacity of the main reservoir 112 is thus defined by the space between the wall defining the lower body portion 104, the wall 118 and the bottom 142 when the upper and lower body portions 102, 104 have been assembled together. In one preferred embodiment, the volumetric capacity of the main reservoir 112 is about 225 ml and the volume of the air filled chamber 116 is about 90.5 $cm^2$. A hot water reservoir 114 is defined, in part, by the cylindrical wall (and integral bottom) 120. The wall 120 is also integral with, and extends downwardly from, the plate 140 inside the chamber 116. The hot water reservoir 114 is sealed from the chamber 116, and except as noted below, also from the main reservoir 112 and the atmosphere. It will be seen that the air filled chamber 116 separating the hot water reservoir 114 from the main reservoir 112 substantially isolates those two reservoirs. The volumetric capacity of the hot water reservoir 114 is defined by the space between the outside walls of a housing 158 of a PTC heater 122 and the inner side of wall (and integral bottom) 120. In one preferred embodiment, the volumetric capacity of the hot water reservoir 114 is about 7.0 ml. As shown, the PTC heater 122 is coupled to the upper body portion 102. A silicone gasket 160 is sandwiched between the flange portion 159 of the housing 158 and a mounting plate 162 to render the inside of the heater 122 water tight. The mounting plate 162, together with another silicon gasket 164, are coupled to the upper body portion via a fastening means. The details of PTC heater 122 are described in detail hereinafter. In one preferred embodiment, and with reference to FIG. 9, the distance $d_1$ between the "long" walls of the housing 158 and the adjacent walls 120 of the hot water reservoir 114 is about 1.8 mm and the distance $d_2$between the "short" walls of the housing 158 and the adjacent walls 120 of the reservoir 114 is about 1.72 mm on one side and about 6.95 mm on the other side (i.e, the housing 158 is not centered within the reservoir 114).

A bore **126*a* through bottom 142 is disposed coaxially with a bore 126*b* through wall 120. A hollow cylindrical extension 144 that is integral with wall 120 sealingly telescopes into an annular grove surrounding bore 126*a* so as to define a passageway between the main reservoir 112 and the hot water reservoir 114. The passageway provides a path for water to travel from the main reservoir 112 to the hot water reservoir 114. Glue or sealant may be applied as needed to make the passageway water tight, i.e., to prevent seepage of water into the chamber 116. Except for the passageway defined by the bores 126*a*,*b*, there is no communication or contact between the main and hot water reservoirs. The size of the bores 126*a*,*b* is large enough to satisfy the steam generating requirements of the heater/hot water reservoir, but small enough to prevent any hot water in the hot water reservoir 114 from heating the water in the main reservoir 112 by any substantial amount in normal operation. In one embodiment, the diameter of these bores is about 2.0 mm. It will be appreciated that the level of water in the main reservoir 112 will always be substantially the same as that in the hot water reservoir 114**.

Figure 7:
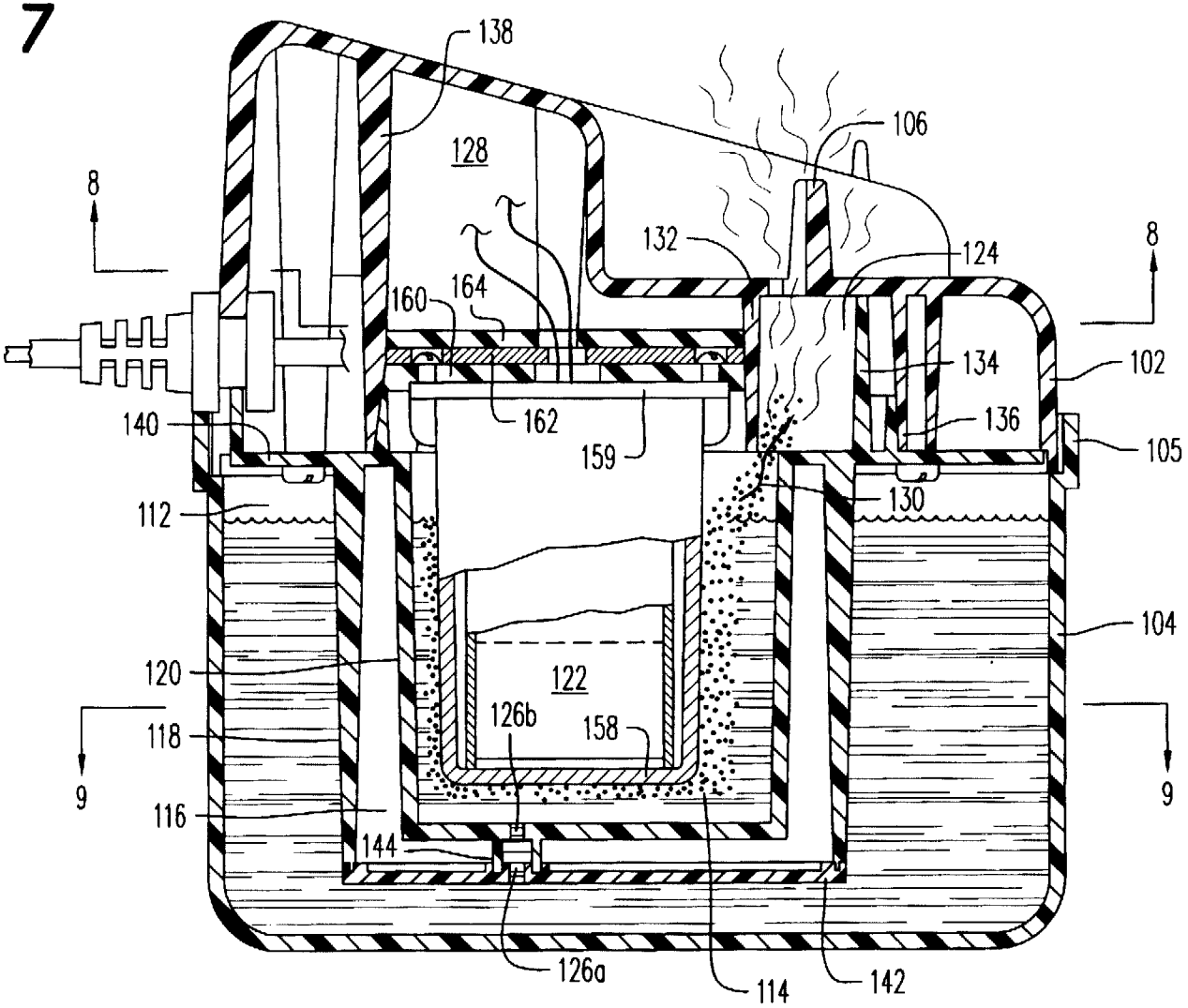
FIG. 7 is a cross section taken along line 7—7 of FIG. 6.
Figure 8:
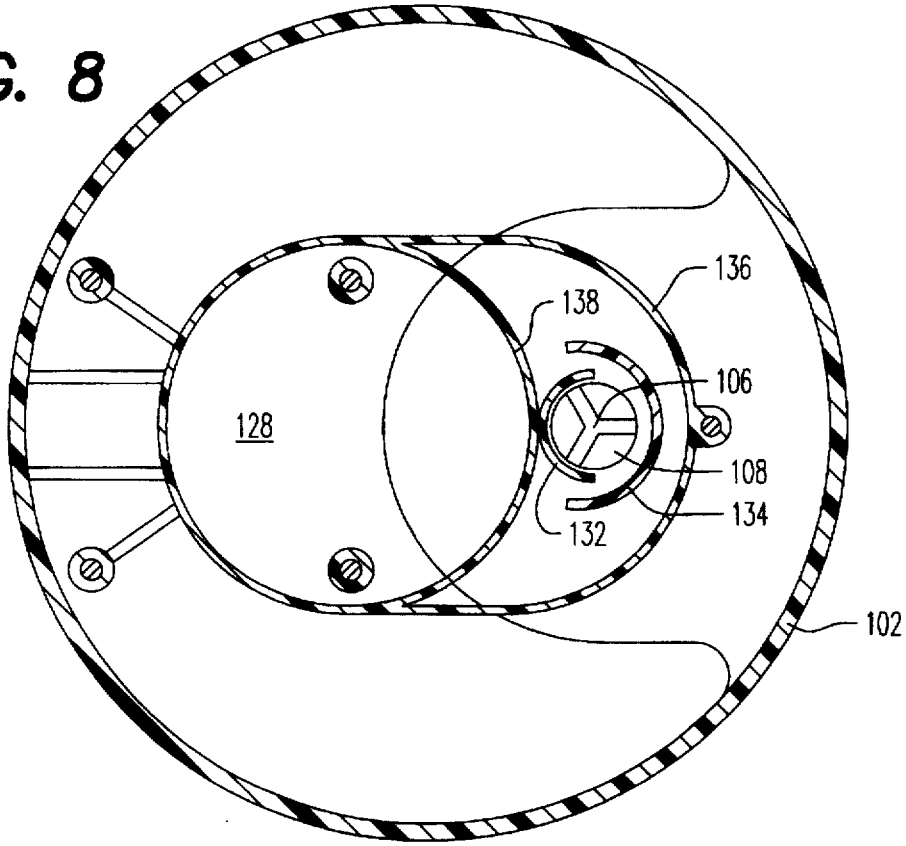
FIG. 8 is a cross section taken along line 8—8 of FIG. 7.
Figure 9:
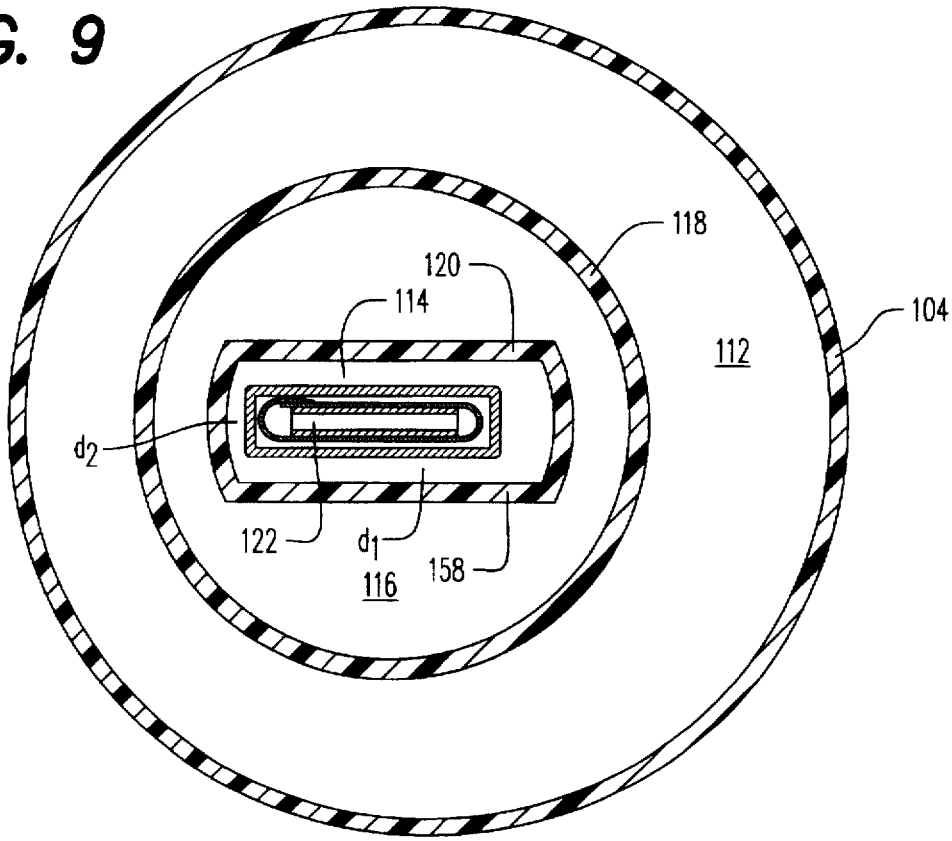
FIG. 9 is a cross section taken along line 9—9 of FIG. 7.
Figure 10:
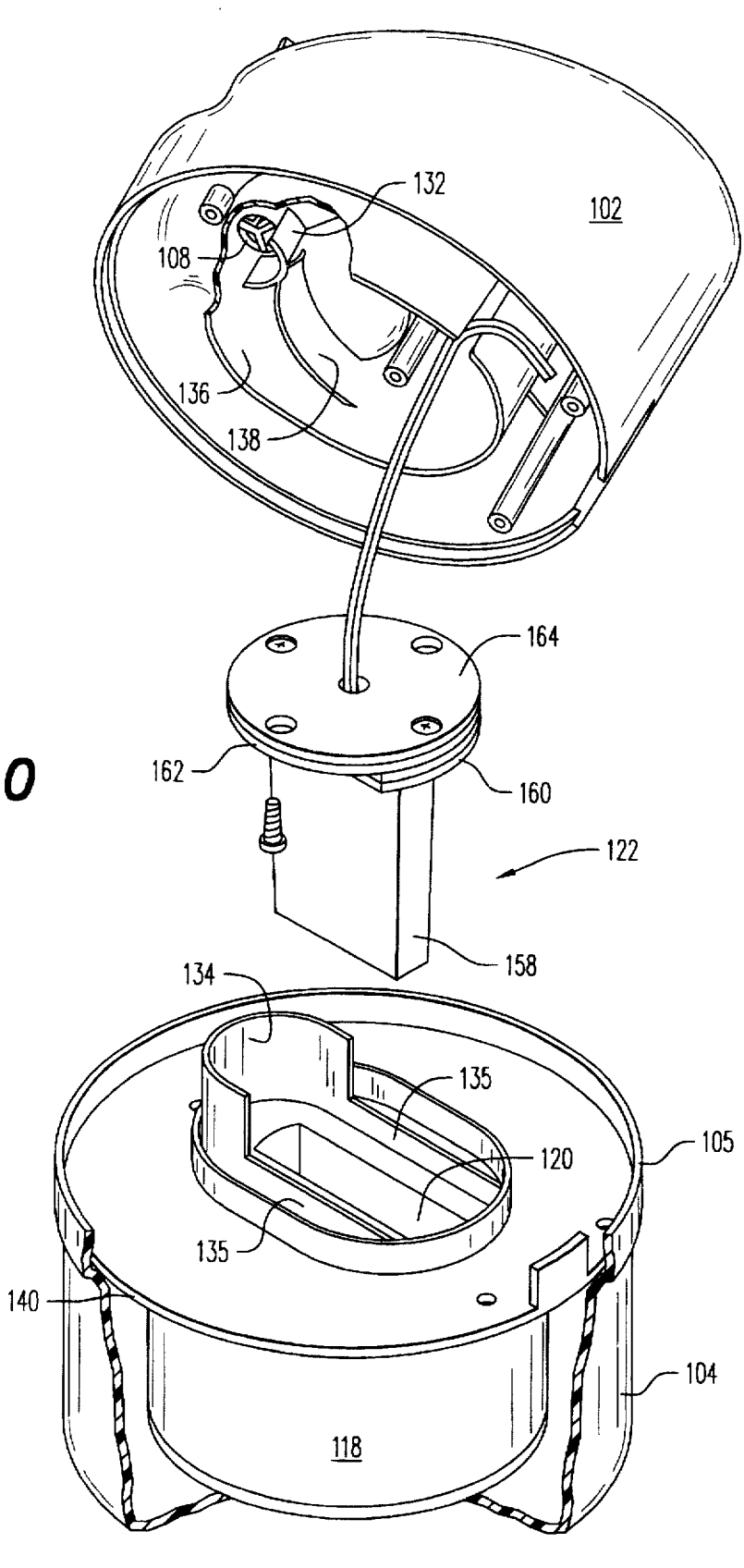
FIG. 10 illustrates an upper body portion of the steamer embodiment illustrated in FIG. 6 in a partially exploded form, and illustrates a lower body portion thereof in a partial cut-away form.

A small passageway 124 couples the hot water reservoir 114 to the steam outlet 108. Thus steam generated in hot water reservoir 114 is permitted to escape via passageway 124 (as shown by arrow 130) to the steam outlet 108 to provide steam for moisturizing hair rollers disposed on post 106. Except for the passageway 124 (whose communication with the exterior is limited by the relatively small steam outlet 106), the hot water reservoir 114 is sealed from the atmosphere. The passageway 124 is defined by an downwardly extending arcuate wall 132 and an opposing, upwardly extending arcuate wall 134, as best seen in FIGS. 7, 8 and 10. The passageway defined by walls 132, 134 is substantially co-axial with steam outlet 108 but offset with respect to the hot water reservoir 114. Referring to FIG. 10, it will be seen that a pair of walls 135 integral with wall 134 define channels along which steam generated in the hot water reservoir 114 may flow toward passageway 124. It will be appreciated that the channels are substantially sealed by the contact of gasket 160 to the edges of walls 135. In one embodiment, the diameter of passageway 124 is about 13.3 mm and the area of steam outlet 108 is about 59 $mm^2$.

Referring still to FIGS. 7, 8 and 10, it will be seen that a generally ovally shaped wall 136 meets with a circular wall 138 to define a chamber 128 which contains electrical connections to a power cord and conventional circuitry, not shown, such as a fuse, and the like.

Preferably, the housing of steamer 100 and all of the interior walls thereof described herein, are constructed of a thermoplastic material, such as polypropylene, except that the walls 118 and 120, the bottom wall 142 and the plate 140 (including upwardly extending portions 134 and 135) are constructed of a nylon composition.

As a consequence of the hot water reservoir 114 being isolated from the from the main reservoir 112 by the air filled chamber 116 separating them and the relatively small diameter of the bores 126*a,b* (which prevents any substantial backflow of hot water from the hot water reservoir 114 to the main reservoir 112), the water in the main reservoir is not heated by any substantial amount by the PTC heater 122 or the hot water in the hot water reservoir 114 in normal operation. Thus, assuming that a user has placed cold water or room temperature water in the main reservoir 112, the temperature of the water therein will not exceed room temperature in normal operation.

As a result of the hot water reservoir 114 being sealed from the atmosphere, except via the small passageway 124 and steam outlet 108, the opportunity for hot water to spill out of the steamer when the unit has been tipped or dropped is minimized. Further, because there is no substantial passageway for sufficient amounts of air to quickly travel into the hot water reservoir 114 to replace the water therein when the unit is tipped, the ability of the hot water to rapidly pour out of the hot water reservoir 114 is significantly restricted. Thus, any hot water spillage occurs relatively slowly.

In addition, as discussed above, the volumetric capacity of the hot water reservoir 114 is very small, particularly in relation to hot water reservoirs of prior art steamers, and also in relation to the volumetric capacity of the main reservoir 112. Thus, even if complete spillage of the hot water reservoir 114 does occur, the amount of hot water available to spill is very small.

Figure 5:
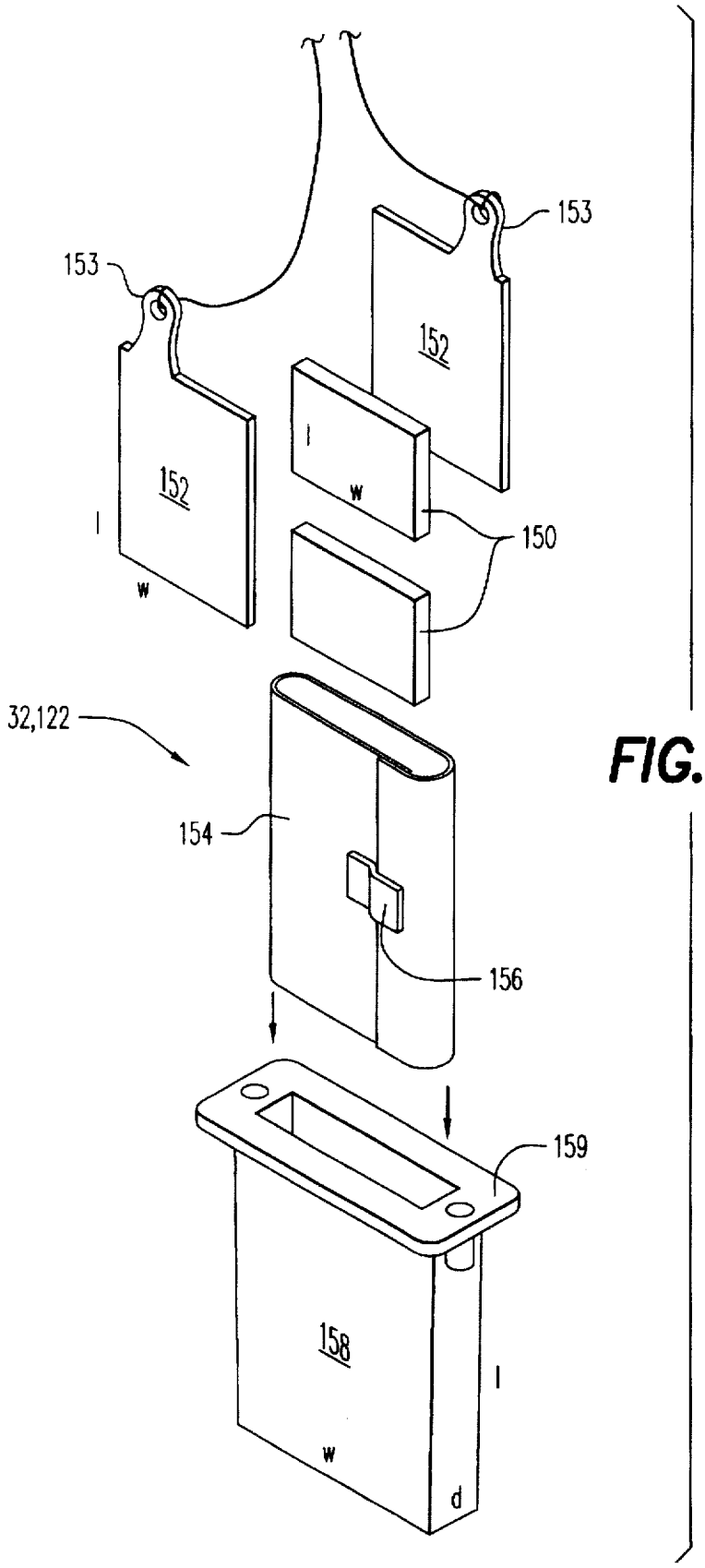
FIG. 5 is an exploded view of a positive temperature coefficient (PTC) heater employed in the practice of the preferred embodiment of the present invention.

FIG. 5 illustrates details of the heater 32, 122 employed in the preferred practice of the invention described above. The heater 32, 122 used in the steamers 10, 100 may be identical, with the only differences being (i) the manner in which the flange portion 159 of the heater housing 158 is mounted to the steamer body, and (ii) the gasket/sealing arrangements employed between the flange portion 159 and the steamer body. Compare FIGS. 2 and 4 to FIGS. 7 and 10.

Each heater 32, 122 comprises a pair of PTC pellets 150, with a peripheral edge of one abutting a peripheral edge of the other. Suitable pellets are available from Sunlead Industrial Co of Hong Kong, R.O.C., as part number 1RA03A, but any pellets having the requisite characteristics will suffice. These pellets measure about 1.4 cm (l) by 2.3 cm (w) and about 21 mm thick, but any pellet sizes can be used provided that they provide the requisite heat output. The pellets 150 are arranged with their longest edges abutting, have a Curie thermal cutoff of about 240° C. (intrinsic cutoff temperature) and have a maximum surge current of 2.5 A at 100–120v. The pellets 150 are sandwiched between a pair of aluminum plates 152 each having a length and width approximately the same as the overall length and width of the abutted pellets 150, i.e., about 2.95 cm (l) by 2.3 cm (w), so that the entire surface area of the faces of the pellets is covered by the plates. A suitable aluminum for the plates is ASM A1100P, having a thickness of about 1.0 mm. Each of the plates has an integral electrical connector 153 to which is attached wiring for connection to AC power. Preferably, the pellets 150 are affixed to the plates 152 by means of a silicone adhesive, such as RTV. This structure (i.e., pellets and plates) is wrapped in an thin (0.05 mm) electrically non-conductive, but thermally conductive sheet of insulation 154 such as Kapton® film, type 200MT so that all surfaces of the structure that may possibly contact housing 158 are covered. A piece of Kapton® tape 156 is employed to hold the film 154 closed.

The housing 158 is preferably an aluminum casting. A suitable aluminum for the housing is SAE 306. The housing's internal dimensions are preferably such that the film wrapped structure described above fits snugly therein so that heat generated by the pellets is transferred to the housing. In one practice of the invention, the thickness of the housing's walls is about 2.0 mm (+/−0.01 mm) and the housing's overall exterior measurements are about 4.0 cm (l) for embodiment 10 and 4.9 cm (l) for embodiment 100, by 3.32 cm (w) as measured at the top and 3.15 cm (w) as measured at the bottom, by 1.04 cm (d) as measured at the top and 0.95 cm (d) as measured at the bottom.

The heater described above has a quiescent power draw of about 150 watts (+/−10%), and provides about 150 watts (+/−10%) of output power. Thus, the heater has relatively low power requirements. In addition, due to the heater's Curie thermal cutoff at about 240° C., the heater never gets hot enough to melt any of the steamer parts, even when the reservoir is completely empty, and therefore poses no hazard if accidently left powered on for an extended period of time.

One characteristic of the above described heater is that, due to the nature of the pellets 150, it is capable of being powered from both 110 VAC and 220 VAC sources without any special circuitry or switches. The heater exhibits the above discussed electrical and temperature cutoff characteristics in the case of either supply voltage.

As will be appreciated by those skilled in the art, the heater thus described is self regulating, and its cutoff temperature is great enough to boil the water in the hot water reservoir (and rapidly from a cold start), but low enough to prevent deterioration of any component parts of the steamer, even in the absence of water in the reservoirs.

In the steamers described above, it is not required to add salt to the water to provide steam generation. When a steamer is constructed as above described, steam generation begins in no more than 50 seconds of the time that the heater has been powered up, and steam suitable for heating hair curlers is generated within even when the main reservoir has been previously filled to capacity with cold tap water.

In the steamer 10 described above, the ratio of the volumetric capacity of the main reservoir to that of the hot water reservoir is about 32:1. In the steamer 100 described above, the ratio of the volumetric capacity of the main reservoir to that of the hot water reservoir is about 40:1. Thus, in one practice of the invention, this ratio is in the range of about 30:1 to 40:1. In the above described embodiments, the ratio of the heater output to the volumetric capacity of the hot water reservoir is in the range of about 19 watts/ml to 33 watts/ml.

It will also be appreciated from the foregoing, and owing, among other things, to the use of a small hot water reservoir, that the overall size of each of the above described steamers may be kept very small and therefore, unlike prior art steamers, may be very compact and highly portable. For example, in one embodiment, the overall size of steamer 10 is about 13.4 cm (l) by 11.3 cm (w) by 9.67 cm (h), and the overall size of steamer 100 is about 6.3 cm (diameter) by 11.2 cm (h).

The present invention may be embodied in on other specific forms without departing from the spirit or essential attributes thereof, and accordingly, reference should be made to the appended claims, rather than to the foregoing specification, as indicating the scope of the invention.

We claim:

1. A portable steam generating apparatus comprising:

a) an integral portable thermoplastic housing comprising separate first and second reservoirs, the first reservoir having an opening for receiving water from a source external to the apparatus, the second reservoir being substantially thermally isolated from the first reservoir by an air chamber and having a volumetric capacity, the first reservoir having a volumetric capacity that is substantially greater than the volumetric capacity of the second reservoir, the second reservoir having an outlet substantially smaller than the cross-section thereof in fluid communication with an ambient atmosphere external to the steam generating apparatus and there being a flow passage from the first reservoir to the second reservoir, the second reservoir being otherwise substantially sealed, each of the first and second reservoirs being constructed of a thermoplastic material;

b) a self regulating heater in thermal communication with an interior of the second reservoir so as to heat water disposed therein, there being no electrical conductors, no electrical components and no electrical connections exposed to the interior of the second reservoir, the heater comprising a positive temperature coefficient PTC thermistor;

the flow passage providing a path for water in the first reservoir to flow to the second reservoir, the heater having an intrinsic cutoff temperature that is great enough to boil the water in the second reservoir and low enough to prevent deterioration of any component parts of the apparatus, including the thermoplastic material, even in the absence of water in the reservoirs, the outlet providing a passage for steam resulting from the boiling water to escape, there being no substantial heating of the water in the first reservoir.

2. A steam generating apparatus according to claim 1 wherein the air chamber runs circumferentially around the second reservoir and the first reservoir runs circumferentially around the air chamber.

3. A steam generating apparatus according to claim 1 wherein the ratio of the volumetric capacity of the first reservoir to that of the second reservoir is in the range of about 30:1 to 40:1.

4. A steam generating apparatus according to claim 1 wherein the volumetric capacity of the second reservoir is no greater than about 7 ml.

5. A steam generator according to claim 1 wherein the volumetric capacity of the second reservoir is no greater than about 7 ml and the volumetric capacity of the first reservoir is no greater than about 225 ml.

6. A steam generating apparatus according to claim 1 wherein the volumetric capacity of the second reservoir and a heat output of the heater are such that, when the first reservoir has been filled to its volumetric capacity with tap water that is no warmer than room temperature and the apparatus is energized, steam generation begins in no more than about 50 seconds thereafter without addition of salt to the water.

7. A steam generating apparatus according to claim 1 wherein the heater has a heat output of about 150 watts (+/−10%).

8. A steam generator according to claim 1 wherein the intrinsic cutoff temperature of the heater is about 240° C.

9. A steam generator according to claim 1 wherein a ratio of a heat output of the heater to the volumetric capacity of the hot water reservoir is about 19 watts/ml to about 33 watts/ml.

10. A steam generating apparatus according to claim 1 wherein the outlet has a surface area of no greater than about 60 $mm^2$ and the outlet is the only substantial path for entry of air into the second reservoir and for escape of hot water and steam from the second reservoir.

11. A steam generating apparatus according to claim 1 further comprising a post disposed over the outlet for holding and steaming a steamable hair curler.

12. A steam generating apparatus according to claim 1 wherein the first and second reservoirs are substantially concentric and wherein the flow path comprises a passageway across the air chamber.

13. A steam generating apparatus according to claim 1 wherein the first and second reservoirs are positioned adjacent each other and are separated by the air chamber and the flow passage comprises a tube coupled to an outlet port of the first reservoir and an inlet port of the second reservoir.

14. A steam generator according to claim 12 further comprising a third reservoir in heat transfer contact with the second reservoir and defining a heat sink, the third reservoir being in fluid communication with the first reservoir but not with the second reservoir and otherwise being sealed to prevent escape of water therefrom.

15. A steam generator according to claim 1 wherein the apparatus is capable of being powered from both a 110 and a 220 VAC source without any switches or circuitry to adapt the heater to the voltage source.

16. A steam generator according to claim 1 wherein the heater comprises an aluminum housing having disposed therein a pair of PTC pellets sandwiched between a pair of aluminum plates that are coupled to wiring for connection to a voltage source, the aluminum plates being in thermal contact with but electrically isolated from the aluminum housing, the aluminum housing coming in to direct contact with water in the second reservoir.

17. A steam generating apparatus according to claim 16 wherein the volume of the hot water reservoir is no greater than about 7 ml, and wherein the outlet has a surface area of no greater than about 60 $mm^2$, the outlet being the only substantial path for entry of air into the hot water reservoir and for escape of hot water and steam from the hot water reservoir, and wherein the heater has a heat output of about 150 watts (+/−10%), a ratio of the heat output of the heater to the volumetric capacity of the hot water reservoir being about 19 watts/ml to about 33 watts/ml.

18. A portable steamer for a steam hair curler comprising:

a) an integral portable thermoplastic housing comprising separate main and hot water reservoirs, the main reservoir having an opening for receiving water from a source external to the steamer, the hot water reservoir being substantially thermally isolated from the main reservoir by an air chamber and having a volumetric capacity, the main reservoir having a volumetric capacity that is substantially greater than the volumetric capacity of the hot water reservoir, the hot water reservoir having a steam outlet substantially smaller than the cross-section thereof and in fluid communication with an ambient atmosphere external to the steamer and there being a flow passage from the main reservoir to the hot water reservoir, the hot water reservoir being otherwise substantially sealed, each of the main and hot water reservoirs being constructed of a thermoplastic material;

b) a post disposed over the steam outlet for holding the steamable hair curler and for orienting the curler so that steam emitted from the outlet is directed into a core portion of the hair curler;

c) a self regulating heater in thermal communication with an interior of the hot water reservoir so as to heat water disposed therein, there being no electrical conductors, no electrical components and no electrical connections exposed to the interior of the hot water reservoir, the heater comprising a positive temperature coefficient PTC thermistor, the heater being capable of being powered from both a 110 and a 220 VAC source without any switches or circuitry to adapt the heater to the voltage source;

d) the flow passage providing a path for water in the main reservoir to flow to the hot water reservoir, the heater having an intrinsic cutoff temperature that is great enough to boil the water in the hot water reservoir to generate steam and low enough to prevent deterioration of any component parts of the apparatus, including the thermoplastic material, even in the absence of water in the reservoirs, the volumetric capacity of the hot water reservoir and a heat output of the heater being such that, when the main reservoir has been filled to its volumetric capacity with tap water that is no warmer than room temperature and the apparatus is energized, steam generation begins in no more than about 50 seconds thereafter without addition of salt to the water, there being no substantial heating of the water in the main reservoir.

19. A steam generating apparatus according to claim 18 wherein the ratio of the volumetric capacity of the main reservoir to that of the hot water reservoir is in the range of about 30:1 to 40:1.

20. A steam generating apparatus according to claim 18 wherein the volume of the second reservoir is no greater than about 7 ml.

21. A portable steamer for a steamable hair curler comprising:

a) an integral portable thermoplastic housing comprising separate main and hot water reservoirs, the main reservoir having an opening for receiving water from a source external to the steamer, the hot water reservoir being substantially thermally isolated from the main reservoir by an air chamber and having a volumetric capacity, the main reservoir having a volumetric capacity that is substantially greater than the volumetric capacity of the hot water reservoir, a ratio of the volumetric capacity of the main reservoir to that of the hot water reservoir being in the range of about 30:1 to 40:1, the hot water reservoir having a steam outlet substantially smaller than the cross-section thereof and in fluid communication with an ambient atmosphere external to the steamer and there being a flow passage from the main reservoir to the hot water reservoir, the steam outlet having a surface area of no greater than about 60 $mm^2$ and being the only substantial path for entry of air into the hot water reservoir and for escape of hot water and steam from the hot water reservoir, the hot water reservoir being otherwise substantially sealed, each of the main and hot water reservoirs being constructed of a thermoplastic material;

b) a post disposed over the steam outlet for holding the steamable hair curler and for orienting the curler so that steam emitted from the outlet is directed into a core portion of the hair curler;

c) a self regulating heater in thermal communication with an interior of the hot water reservoir so as to heat water disposed therein, there being no electrical conductors, no electrical components and no electrical connections exposed to the interior of the hot water reservoir, the heater comprising a positive temperature coefficient PTC thermistor, a heat output of about 150 watts (+/−10%), a ratio of the heat output of the heater to the volumetric capacity of the hot water reservoir being in the range of about 19 watts/ml to about 33 watts/ml, and the heater being capable of being powered from both a 110 and a 220 VAC source without any switches or circuitry to adapt the heater to the voltage source;

the flow passage providing a path for water in the main reservoir to flow to the hot water reservoir, the heater having an intrinsic cutoff temperature that is great enough to boil the water in the hot water reservoir to generate steam and low enough to prevent deterioration of any component parts of the apparatus, including the thermoplastic material, even in the absence of water in the reservoirs, the volumetric capacity of the hot water reservoir and a heat output of the heater being such that, when the main reservoir has been filled to its volumetric capacity with tap water that is no warmer than room temperature and the apparatus is energized, steam generation begins in no more than about 50 seconds thereafter without addition of salt to the water, there being no substantial heating of the water in the main reservoir.

* * * * *

UNITED STATES PATENT AND TRADEMARK OFFICE

CERTIFICATE OF CORRECTION

PATENT NO. : 5,761,378
DATED : June 2, 1998
INVENTOR(S) : Boyle et al

It is certified that error appears in the above-indentified patent and that said Letters Patent is hereby corrected as shown below:

Column 4, line 27, cancel "ia" and substitute therefor --is--.

Column 5, line 13, cancel "it" and substitute therefor --its--.

Column 5, line 27, cancel "iv)" and substitute therefor --(iv)--.

Column 6, line 44, cancel "silicon" and substitute therefor --silicone--.

Column 7, line 42, cancel "from the" first occurrence.

Column 7, line 16, cancel "106" and substitute therefor --108--.

Signed and Sealed this

Twenty-fifth Day of August, 1998

Bruce Lehman

*Attest:*

BRUCE LEHMAN

*Attesting Officer*

*Commissioner of Patents and Trademarks*